US005222474A

United States Patent [19]

Yencha, III

[11] Patent Number: 5,222,474

[45] Date of Patent: * Jun. 29, 1993

[54] CONVECTION COOKING OVEN WITH ENHANCED TEMPERATURE DISTRIBUTION UNIFORMITY

[75] Inventor: Michael V. Yencha, III, Freeland, Pa.

[73] Assignee: Garland Commercial Industries, Inc., Freeland, Pa.

[ * ] Notice: The portion of the term of this patent subsequent to Jun. 16, 2009 has been disclaimed.

[21] Appl. No.: 805,106

[22] Filed: Dec. 11, 1991

Related U.S. Application Data

[63] Continuation of Ser. No. 436,433, Nov. 14, 1989.

[51] Int. Cl.[5] ..... F24C 15/32

[52] U.S. Cl. ..... 126/21 A; 432/199; 432/176; 431/329

[58] Field of Search ..... 126/21 A; 34/225; 432/199, 176; 431/329; 239/DIG. 23

[56] References Cited

U.S. PATENT DOCUMENTS

| | | | |
|---|---|---|---|
| 3,217,701 | 11/1965 | Weiss | 431/329 |
| 3,324,844 | 6/1967 | Huffman | 126/21 A |
| 3,407,025 | 10/1968 | Hardison | 431/329 |
| 3,710,775 | 1/1973 | Tamada et al. | 126/21 A |
| 3,926,106 | 12/1975 | Deusing et al. | 99/447 |
| 3,975,140 | 8/1976 | Placek | 431/329 |
| 3,991,737 | 11/1976 | Del Fubbro | 126/21 A |
| 4,108,139 | 8/1978 | Gilliom et al. | 126/21 A |
| 4,395,233 | 7/1983 | Smith et al. | 431/176 |
| 4,467,777 | 8/1984 | Weber | 126/21 A |
| 4,498,453 | 2/1985 | Ueda | 126/21 A |
| 4,516,012 | 5/1985 | Smith et al. | 219/400 |
| 4,599,066 | 7/1986 | Granberg | 431/329 |
| 4,648,377 | 3/1987 | Van Camp | 126/21 A |
| 4,671,250 | 6/1987 | Hurley | 126/21 A |
| 4,867,132 | 9/1989 | Yencha | 126/21 A |
| 4,878,837 | 11/1989 | Oho | 431/329 |
| 5,016,606 | 5/1991 | Himmel et al. | 432/176 |
| 5,121,737 | 6/1992 | Yencha | 126/21 A |

*Primary Examiner*—Carroll B. Dority

*Attorney, Agent, or Firm*—Hubbard, Thurman, Tucker & Harris

[57] ABSTRACT

A gas fired convection cooking oven is provided with an improved air delivery and heat exchange structure for creating within the oven's cooking chamber a recirculating flow of heated air to cook food items supported therein. The structure includes a combustion box adapted to receive hot products of combustion from a gas burner, and extending into the cooking chamber through a lower portion of a vertical boundary wall thereof. Removably secured to the combustion box, and extending upwardly along the inner side of the boundary wall is a hollow baffle structure having a front mixing chamber communicating with the interior of the combustion box through spaced apart hollow legs with a discharge opening formed therebetween. Perforated skirt walls extending rearwardly from the mixing chamber define with the boundary wall a fan chamber which surrounds a motor-driven centrifugal fan impeller supported on the inner side of the boundary wall. During oven operation the recirculating air flow is drawn from the cooking chamber into the mixing chamber, mixed with burner combustion products and flowed into the fan. The flow is then ejected from the fan and forced into the cooking chamber through the skirt wall perforations and through the discharge opening between the mixing chamber leg portions. Removal of the baffle structure from the combustion box and the boundary wall conveniently exposes the fan impeller within the cooking chamber for inspection, cleaning and service purposes.

12 Claims, 3 Drawing Sheets

CONVECTION COOKING OVEN WITH ENHANCED TEMPERATURE DISTRIBUTION UNIFORMITY

This application is a continuation of U.S. application Ser. No. 436,433, filed Nov. 14, 1989 pending and titled "Convection Cooking Oven With Enhanced Temperature Distribution Uniformity".

BACKGROUND OF THE INVENTION

The present invention relates generally to cooking apparatus and, in a preferred embodiment thereof, more particularly provides a gas fired convection cooking oven which is provided with an improved air delivery and heat exchange section.

Cooking ovens in which heated air is continuously recirculated through a cooking chamber, to cook food items supported therein, are commonly referred to as "convection" ovens. A motor-driven fan impeller positioned within the oven housing is typically utilized to create the recirculating air flow through the cooking chamber, and cooking heat is conventionally transferred to the recirculated air by means of a gas burner whose combustion products are flowed directly into the fan impeller and/or flowed through a heat exchanger operably interposed in the path of the recirculating air.

A conventional direct-fired convection oven of this general type is illustrated in U.S. Pat. No. 4,648,377 to Van Camp. In the Van Camp oven a centrifugal fan impeller is positioned behind a single metal baffle plate vertically secured within the oven housing and generally defining a side boundary of the cooking chamber. The baffle plate has a central return opening through which recirculating air is returned from the cooking chamber to the fan impeller inlet, and peripheral edge passages through which heated air is forced by the fan impeller into the cooking chamber.

Circumscribing the fan impeller behind the baffle plate is a bifurcated heat exchanger structure having upper and lower manifolds respectively positioned above and below the fan, and a pair of generally U-shaped flow tubes positioned on peripherally opposite sides of the impeller and interconnected between the interiors of the upper and lower manifolds.

During operation of the oven the products of combustion from a gas burner are flowed sequentially into the lower manifold, upwardly through the tubes, and into the upper manifold. Air radially discharged from the impeller is flowed outwardly across and is heated by the external surface of the heat exchanger before being forced through the baffle plate peripheral openings into the cooking chamber.

The burner combustion products entering the upper manifold are discharged therefrom through a downward extension thereof positioned between the central baffle plate opening and the impeller inlet. The discharged combustion products are mixed with return air being drawn into the impeller, thereby directly transferring residual combustion product heat to the recirculating air flow. In alternate embodiments of the Van Camp oven, the upper manifold is eliminated and the open outer ends of the flow tubes are bent inwardly to a position directly in front of the impeller inlet to discharge burner combustion products directly into the impeller inlet.

Despite the apparent heat transfer efficiency of these air delivery and heat exchange structures, they have several inherent limitations and disadvantages. For example, they are fairly complex and relatively expensive to fabricate, assemble and install, thereby increasing the overall cost of the oven. Additionally, access to the fan impeller for cleaning, repair or replacement is somewhat inconvenient because the impeller is positioned behind the baffle plate, which is secured at various locations thereon to the interior of the oven housing, and is also partially blocked by the upper manifold or, as the case may be, outer end portions of the flow tubes. Thus, an appreciable amount of disassembly, and subsequent reassembly, is required to service the fan impeller.

Other conventional gas or electrically heated convection ovens having one or more of these disadvantages and limitations are representatively illustrated in U.S. Pat. No. 3,710,775 to Tamada et al; U.S. Pat. No. 3,991,737 to Del Fabbro; U.S. Pat. No. 4,108,139 to Gilliom et al; U.S. Pat. No. 4,467,777 to Weber; and U.S. Pat. No. 4,671,250 to Hurley et al.

It is accordingly an object of the present invention to provide a gas fired convection oven having an internal air delivery and heat exchange structure which may be easily, rapidly and inexpensively fabricated, assembled and installed and provides rapid and complete access to the fan impeller from the interior of the cooking chamber.

SUMMARY OF THE INVENTION

In carrying out principles of the present invention, in accordance with a preferred embodiment thereof, an improved air delivery and heat exchange structure is incorporated in a gas fired convection cooking oven having a cooking chamber separated from a motor and burner chamber by a vertically extending boundary wall of the cooking chamber.

The air delivery and heat exchange structure functions to create within the cooking chamber a recirculating flow of heated air to cook items supported therein and comprises a combustion box having a front portion extending inwardly through a lower portion of the boundary wall into the cooking chamber. A gas burner is positioned in the motor and burner chamber and has a discharge end, formed from a cylindrical, spirally wound wire mesh material, which projects forwardly into the combustion box. Also positioned in the motor and burner chamber is a fan motor used to drive a centrifugal fan impeller supported on the boundary wall within the cooking chamber above the inwardly projecting front portion of the combustion box.

Removably secured to the front combustion box portion, and extending upwardly therefrom along the boundary wall, is a hollow baffle structure having a vertically extending front wall with a central opening therein, and interconnected perforated skirt walls extending rearwardly to the boundary wall from the top edge and vertical side edges of the front wall. A vertical dividing wall positioned within the baffle structure and having a central outlet opening therein divides the baffle structure interior into a mixing chamber positioned between the front and dividing walls, and a fan chamber which receives the fan impeller and extends between the dividing wall and the boundary wall.

At their lower ends the front and dividing walls form a spaced pair of hollow, open-ended legs which are releasably held over corresponding outlet openings in the front combustion box portion by clip means formed on the combustion box adjacent such outlet openings, the leg portions forming therebetween an outlet opening which intercommunicates the cooking and fan chambers. A flange formed on the upper skirt wall is screwed to the boundary wall to thereby releasably hold the rear edges of the skirt wall against the boundary wall.

During operation of the fan and burner, combustion products from the burner flow upwardly through the leg portions into the mixing chamber, while an air-combustion product mixture is drawn from the cooking chamber into the mixing chamber through the inlet opening in the baffle structure front wall. These two flows are drawn into the fan impeller inlet through the dividing wall outlet opening, flowed into the fan chamber through the fan impeller outlet, and then forced back into the cooking chamber through the skirt wall perforations and a flow passage defined around the side and top of the baffle structure, and through the outlet opening between the baffle structure inlet leg portions.

Removal of the baffle structure from the boundary wall and the combustion completely exposes the fan impeller within the cooking chamber, thereby providing substantially unimpeded access thereto from within the cooking chamber. Both the baffle structure and the combustion box can be easily and rather inexpensively formed from flat sheet metal stampings which are appropriately bent to form these two simple structures.

DETAILED DESCRIPTION

Figure 1:
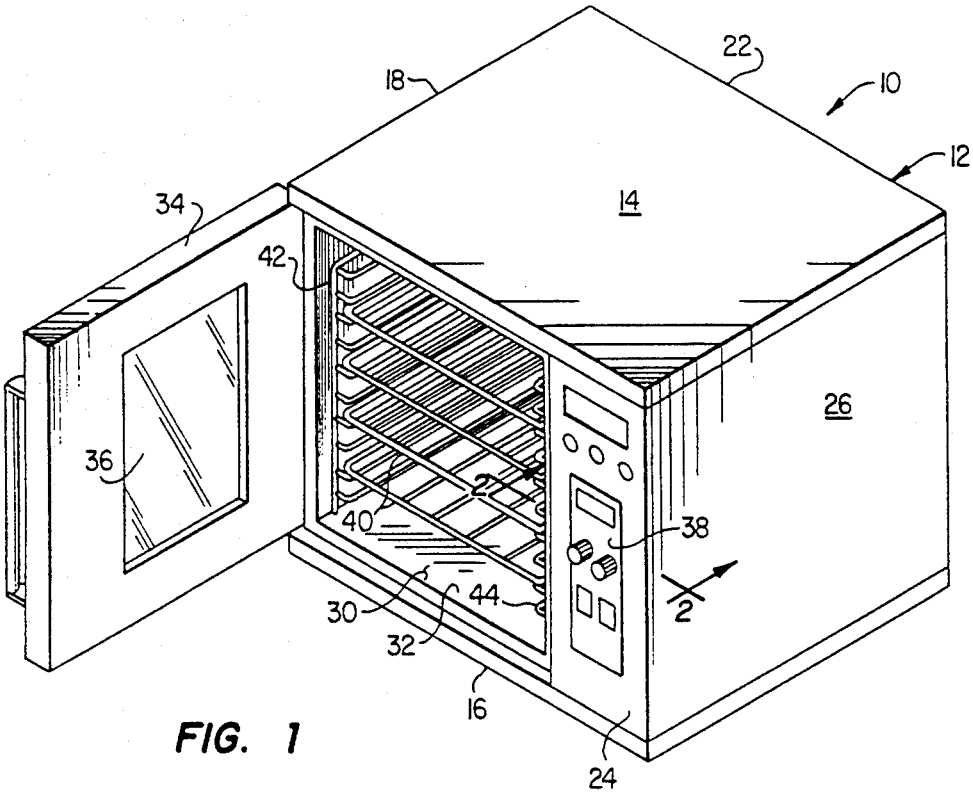
FIG. 1 is a perspective view of an improved gas fired convection oven embodying principles of the present invention.

Perspectively illustrated in FIG. 1 is an improved gas fired convection oven 10 which embodies principles of the present invention. The oven 10 is provided with a housing 12 formed for the most part from internally insulated hollow metal walls including top and bottom walls 14 and 16, a left exterior side wall 18, a right interior side wall 20 (FIG. 2), and a rear wall 22. An uninsulated right side portion 24 of the housing is provided with a side access panel 26 and defines therein a motor and burner chamber 28.

A cooking chamber 30 is positioned within the housing to the left of the insulated interior wall 20, whose inner side forms a boundary surface of the cooking chamber, and is accessible through a front housing side opening 32. A suitable access door 34 having a transparent viewing panel 36 therein is pivotally mounted on the housing to cover and uncover the access opening 32. A control panel 38 (FIG. 1) is mounted on the front side of the housing 12, to the right of the door 34, and is utilized to regulate the operation of the oven 10 in a suitable manner.

A series of metal food support racks 40 are horizontally and removably supported within the cooking chamber 30 by means of vertically extending rack support structures 42 and 44 respectively extending along the left and right interior sides of the cooking chamber. In a generally conventional manner, food items placed on the horizontal racks 40 are subjected to and cooked by a recirculating flow of heated air which traverses the cooking chamber 30 in a manner subsequently described. For purposes of illustrative clarity, the food support racks 40, and their support structures 42 and 44 have been illustrated only in FIG. 1.

Figure 2:
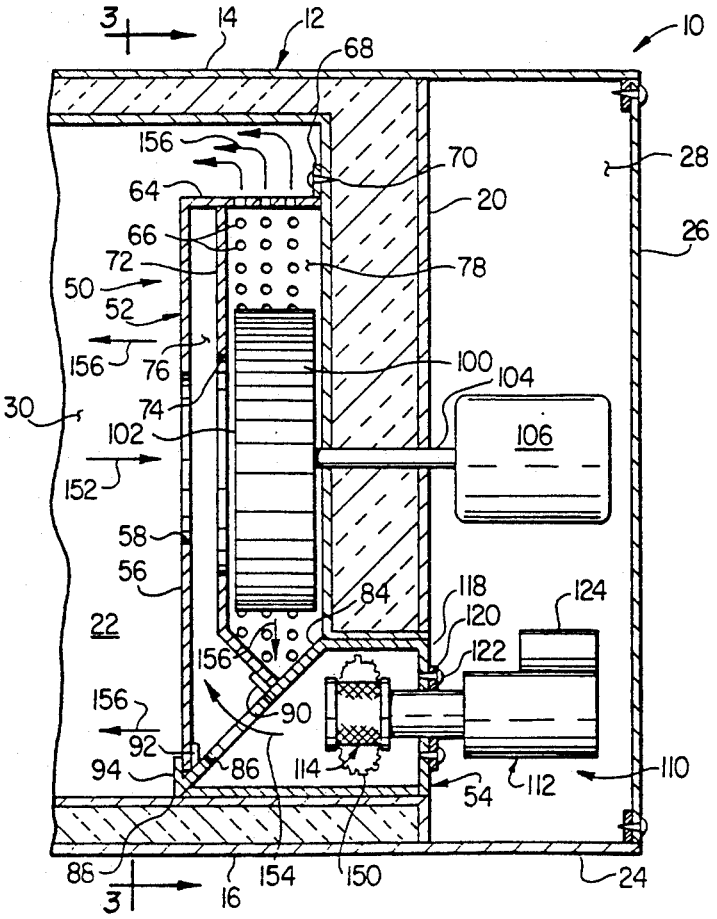
FIG. 2 is an enlarged scale partial cross-sectional view through the oven, taken along line 2—2 of FIG. 1, with the food support structure within the oven's cooking chamber removed for illustrative clarity.

Referring now to FIGS. 2–5, the present invention incorporates in the oven 10 an improved air delivery and heat exchange structure 50 which, compared to its conventional counterparts typically utilized in convection ovens of this general type, provides a variety of structural and operational advantages. Structure 50 includes a vertically extending chambered baffle portion 52 which is removably supported on and projects upwardly from a base portion 54 which rests upon the bottom housing wall 16 and, in a manner subsequently described, functions as a combustion box. As best illustrated in FIG. 2, the chambered baffle portion 52 is positioned within the cooking chamber 30 against the insulated right side interior wall 20, and the base portion 54 extends through the wall 20 into the motor and burner chamber 28.

The baffle portion 52 has a vertically elongated, generally rectangular front wall 56 having a circular opening 58 formed centrally therethrough. Extending rearwardly from the side and top edges of the front wall 56 are interconnected side and top skirt walls 60, 62 and 64, each of which has a spaced series of relatively large circular perforations 66 formed in a rear portion thereof. The rear side edges of the skirt walls 60, 62 and 64 are positioned against the insulated interior housing side wall 20 as best illustrated in FIG. 2, and the top skirt wall 64 is provided at its rear side edge with an upturned mounting flange 68 which is secured to the housing wall 20 with suitable fasteners such as screws 70 (FIG. 2).

Secured within the generally U-shaped skirt wall portion of the chambered baffle structure 52 is an interior wall 72 which is parallel to the front wall 56, and is spaced rearwardly therefrom and forwardly of the skirt wall perforations 66. A central circular opening 74 is formed in the interior wall 72 and is axially aligned with, and of a somewhat greater diameter than the opening 58 in the front wall 56. The front and rear walls 56, 72 define therebetween a vertically extending mixing chamber 76 within the baffle portion 52, while the interior wall 72 defines with the skirt walls 60, 62 and 64 and the interior housing wall 20 a considerably wider fan chamber 78 behind the mixing chamber 76. On opposite sides thereof, lower end portions of the baffle structure walls 56 and 72 form downwardly and rearwardly sloped hollow legs 80 having open lower ends. The legs 80 from therebetween a horizontally elongated rectangular opening 82 at the base of the baffle portion 52 (see FIG. 3).

Figure 3:
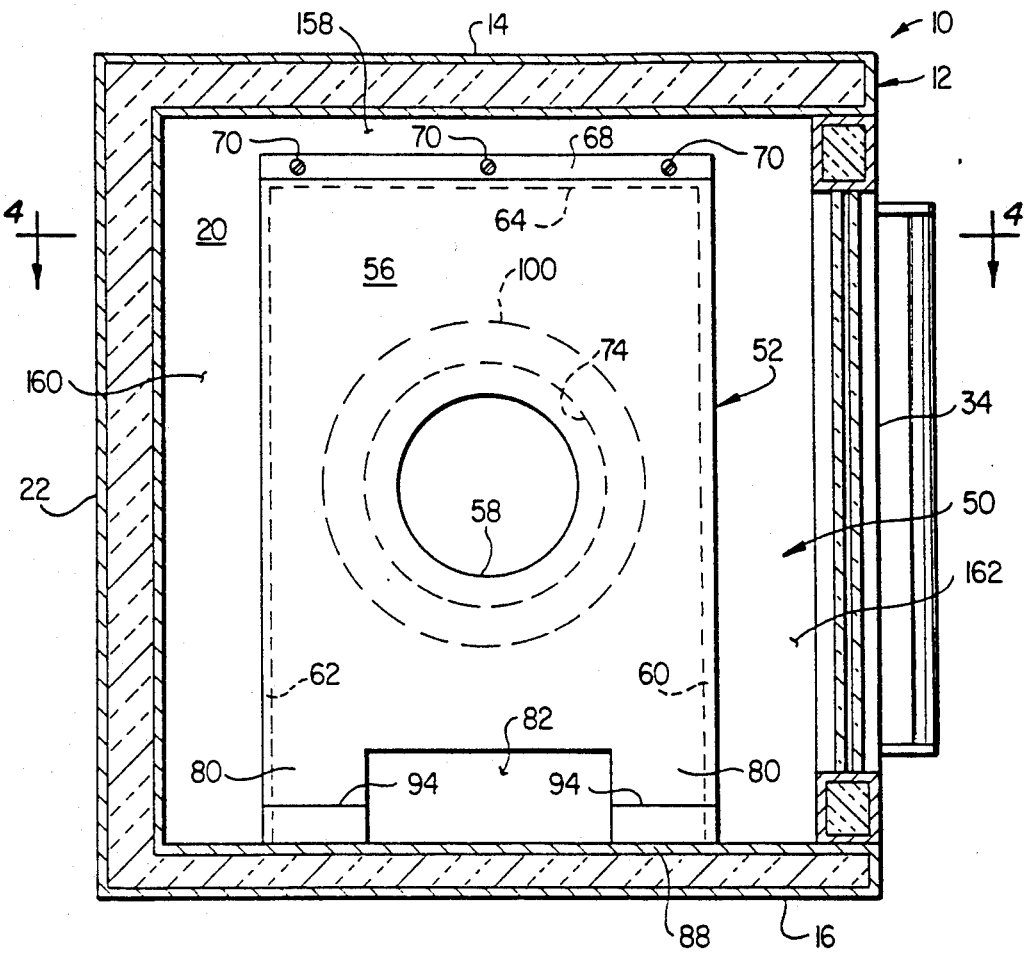
FIG. 3 is a cross-sectional view through the oven taken along line 3—3 of FIG. 2.
Figure 4:
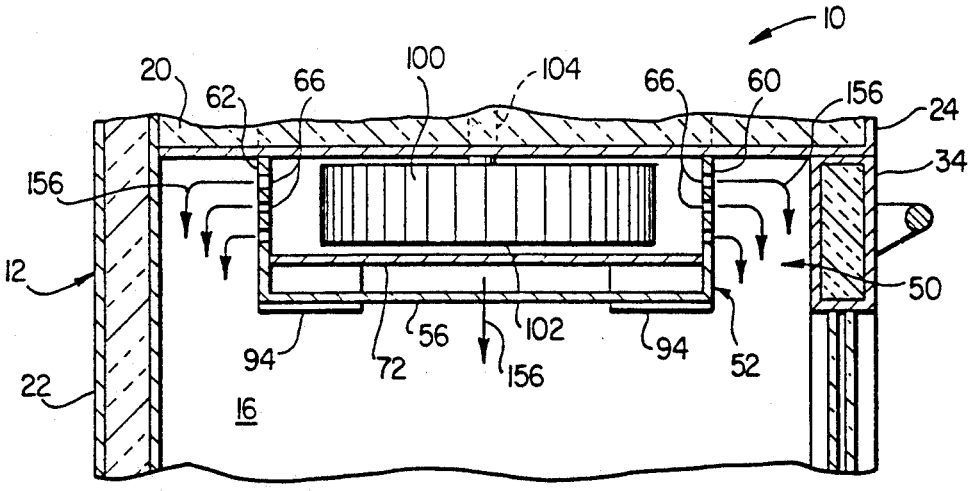
FIG. 4 is a partial cross-sectional view through the oven taken along line 4—4 of FIG. 3.
Figure 5:
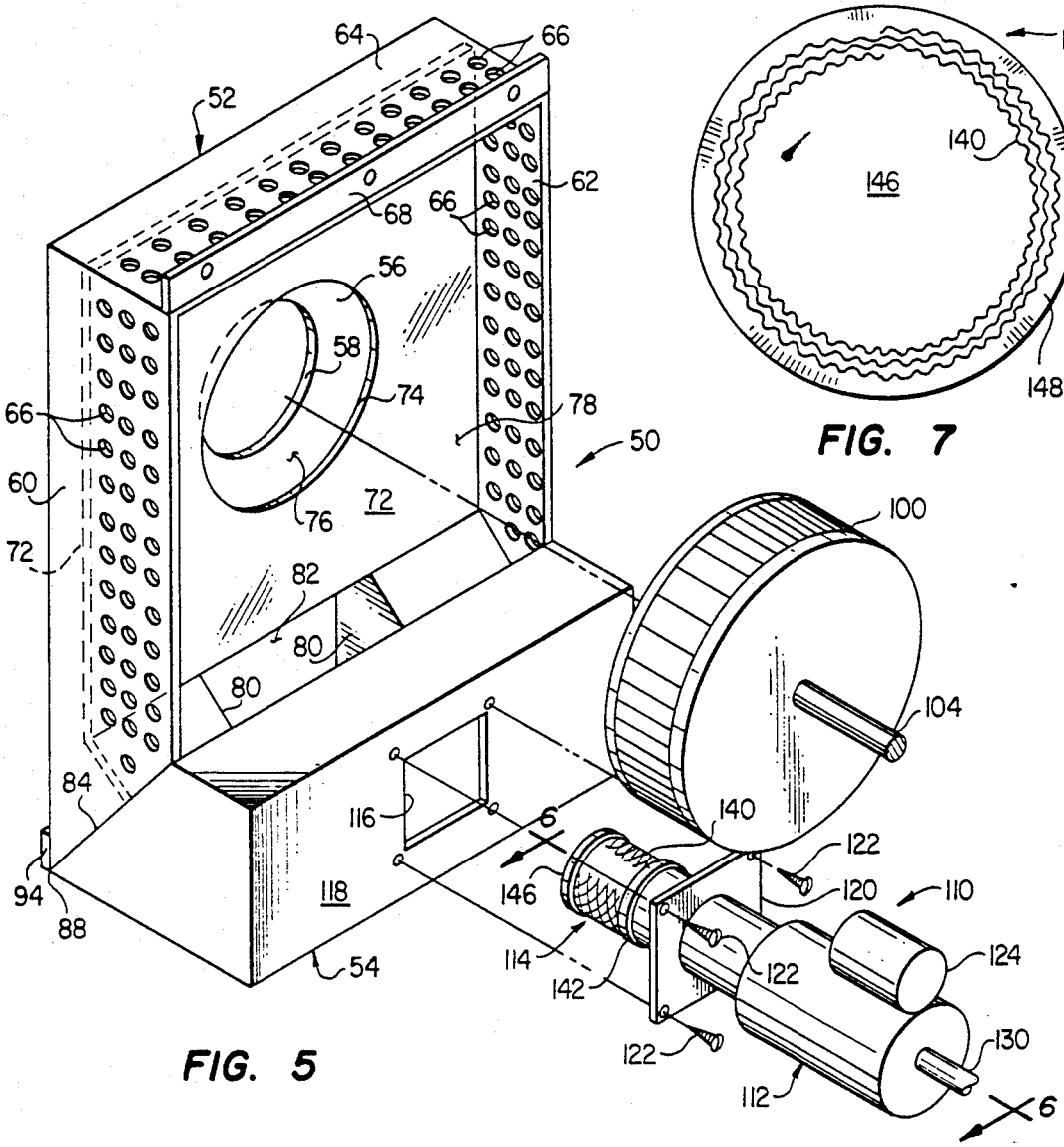
FIG. 5 is an enlarged scale, partially exploded perspective view of an improved air delivery and heat exchange structure incorporated in the oven.
Figure 7:
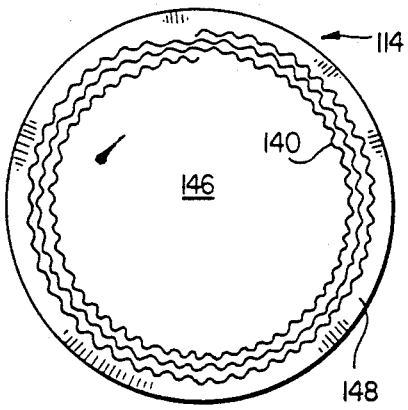
FIG. 7 is an enlarged scale cross-sectional view through the discharge end of the burner, taken along line 7—7 of FIG. 6.
Figure 6:
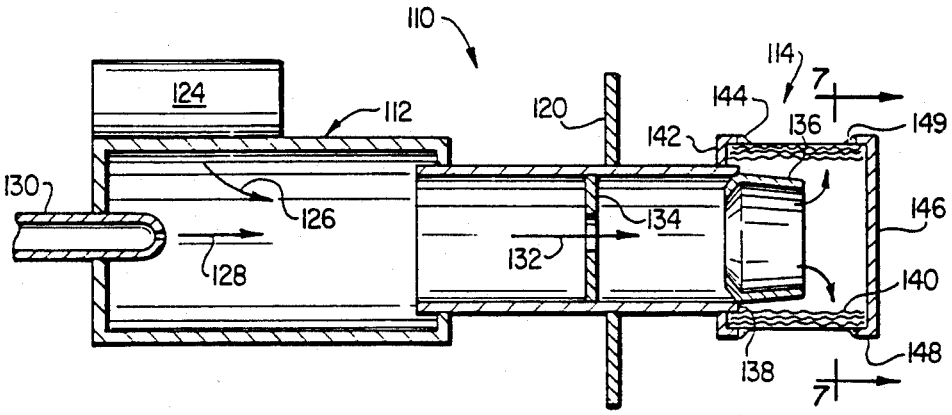
FIG. 6 is an enlarged scale, somewhat schematic cross-sectional view through the burner portion of the air delivery and heat exchange structure, taken along line 6—6 of FIG. 5.

The base portion 54 of the air delivery and heat exchange structure 50 is provided with a downwardly and forwardly sloping front wall 84 having a pair of rectangular openings 86 (see FIG. 2) formed through its opposite ends adjacent its lower front side edge 88. Along the upper and lower side edges of each of the wall openings 86 a pair of outwardly projecting upper and lower alignment tabs 90 and 92 are formed, such alignment tabs being received within the open lower ends of the baffle structure legs 80 as best illustrated in FIG. 2. A pair of upturned retaining tabs 94 are formed on opposite ends of the lower front side edge 88 of the base portion front wall 84 and extend upwardly along front sides of the legs 80 as best illustrated in FIG. 3. The tabs 90, 92 and 94 function to removably support the open lower ends of the legs 80 over the wall openings 86 in the base portion 54, while the mounting flange 68 functions to removably connect an upper end portion of the chambered baffle structure 52 to the interior housing wall 20. For purposes later described, the entire chambered baffle structure 52 may be removed simply by removing the screws 70 and disengaging the legs 80 from their associated tabs 90, 92 and 94 on the base portion 54.

Operatively positioned within the fan chamber 78 is a centrifugal fan impeller 100 having an inlet 102 which is coaxial with and positioned directly behind the interior wall opening 74 of the baffle structure. The fan impeller 100 is rotationally drivable by means of a drive shaft 104 extending through the interior housing wall 20 and connected to a fan motor 106 positioned in the motor and burner chamber 28 as best illustrated in FIG. 2.

Referring now to FIGS. 2 and 5–7, the air delivery and heat exchange structure 50 also includes a gas burner 110 having a hollow, generally cylindrical body portion 112 positioned in the motor and burner chamber 28, and a discharge tip portion 114 which is inserted into the base portion 54 through a rectangular opening 116 formed in its rear wall 118. The burner 110 is supported in the chamber 28 by means of a rectangular mounting flange 120 externally welded to the burner body 112 and removably secured to the base portion rear wall 118 by screws 122. Burner 110 is of an air boosted type and has a blower 124 secured to its body 112 and adapted to force pressurized air 126 into the burner body for mixture with pressurized gaseous fuel 128 supplied to the body interior by a suitable gas supply pipe 130. The incoming air and fuel stream 126 and 128 are mixed within the burner body 112 to form a fuel-air mixture 132 that is forced forwardly through an orifice washer 134 secured within the burner body to facilitate the mixing of the incoming air and fuel. The fuel-air mixture 132 is flowed into the tip section 114 through an outlet fitting 136 secured to the inner end 138 of the burner body.

The burner tip section 114 comprises a hollow cylindrical spirally wound section 140 of metal wire mesh which is received at one end in an annular external mounting flange 142 secured to the inner end 138 of the burner body. An annular braze bead 144 is used to fixedly secure the wire section 140 to the flange 142. A circular cap member 146 having a peripheral flange 148 is fixedly secured over the opposite end of the mesh section 140 by means of a braze bead 149. During operation of the burner 110, the fuel-air mixture 132 is forced laterally outwardly through the wire mesh section 140 around its periphery, and is ignited by conventional igniter means (not illustrated) to form around the mesh section periphery a compact "blue flame" 150 positioned within the base portion 54 as illustrated in FIG. 2. The overlapping mesh construction of the section 140 provides a very economical and easily fabricated means for evenly distributing and uniformly diffusing the flame around the burner tip. However, if desired, an alternate, generally porous material (such as a porous ceramic material) could be used in place of the illustrated wire mesh.

During operation of the oven 10 a flow 152 of return air and combustion products is drawn through the front wall opening 58 into the mixing chamber 76 by operation of the fan 100, and is mixed in chamber 76 with combustion products 154 emanating from the flame 150 and flowed upwardly through the chamber 76 through the open leg portions 80 of the baffle portion 52. The return air-combustion product mixture in the chamber 76 is drawn into the fan inlet 102 through the interior wall opening 74 and is ejected radially from the fan impeller 100 into the fan chamber 78. The return air-combustion product mixture 156 forced into the fan chamber 78 is forced outwardly through the skirt wall perforations 66, and forwardly through the rectangular opening 82 between the baffle structure legs 80. The return air-combustion product mixture 156 exiting the baffle structure in this manner is then flowed outwardly into the cooking chamber 30 through the rectangular opening 82, as well as through a supply passage having top and side supply portions 158, 160 and 162 defined between the top and vertical side walls of the baffle structure 52 and the top and vertical side surfaces of the cooking chamber 30. In this manner, the air-combustion product mixture 156 is very evenly distributed throughout the cooking chamber 30 as it is recirculated therethrough and functions to cook food items operatively supported on the racks 40 within the cooking chamber. This very even cooking air distribution within the cooking chamber 30 is further enhanced by the skirt wall perforations 66 which serve to evenly diffuse the air-combustion product mixture exiting the top and vertical side wall portions of the baffle structure 52. In a conventional manner vent means (not illustrated) are provided to continuously exhaust from the cooking chamber a small portion of the air-combustion product mixture being circulated therethrough.

The portion of the flow 156 downwardly discharged from the fan 100 impinges upon the outer side surface of the base portion front wall 84 and is also flowed along the rear and vertical side surfaces of the baffle structure inlet legs 80 to thereby very efficiently receive heat from and cool these hottest portions of the overall air delivery and heat exchange structure 50.

It can readily be seen from the foregoing that the air delivery and heat exchange structure 50 of the present invention provides distinct and structural and operational advantages compared to conventional air delivery and heat exchange structures utilized in convection ovens of this general type. For example, the chambered baffle portion 52 and the base portion 54 may be easily and relatively inexpensively formed from flat sheet metal stampings which are appropriately bent and intersecured to form these two structural elements. Despite this structural simplicity, the releasably intersecured baffle and base portions 52 and 54 serve to simultaneously transfer heat to the air discharge from the fan 100 and directly flow burner combustion products into the inlet of the fan.

However, despite this very desirable and efficient dual heat transfer function provided by the baffle and base portions 54, both the fan and burner elements 100, 110 are very easily and rapidly accessible for inspection, service and maintenance. For example, complete access to the fan impeller 100 from within the cooking chamber is rapidly achieved simply by removing the screws 70 and pulling the baffle structure 52 outwardly from the base portion 54 to completely expose the fan impeller 100 within the cooking chamber 30. Rapid reassembly of the baffle and base portion 54 is easily accomplished by simply reengaging the baffle structure legs 80 with their base portion clips and reinserting the screws 70. Additionally, complete access to the fan motor 106 and the gas burner 110 is achieved simply by removing the side access panel 26.

The foregoing detailed description is to be clearly understood as being given by way of illustration and example only, the spirit and scope of the present invention being limited solely by the appended claims.

What is claimed is:

1. A method of mixing hot combustion gas from a burner with recirculating cooking gas to enhance temperature uniformity in a convection oven comprising the steps of:

discharging cooking gas in a radial manner from a periphery of a centrifugal impeller positioned at one wall of a cooking chamber to create a flow of cooking gas along interior surfaces of a top, bottom and two side walls of the cooking chamber adjacent to the centrifugal impeller;

returning the cooking gas through a middle of the cooking chamber and into an opening in a structure defining a mixing chamber poised between the returning cooking gas and the centrifugal impeller, the mixing chamber structure having dimensions that do not substantially impede the discharge of cooking gas from the centrifugal impeller and its flow along the top, bottom and two side walls of the cooking chamber when the structure is positioned between the returning cooking gas and the centrifugal impeller;

circumscribing the returning cooking gas with hot combustion gas in the mixing chamber to create a flow of cooking gas and hot combustion gas to a central inlet of the centrifugal impeller for discharge to the cooking chamber, the flow of cooking gas and hot combustion gas having a relatively uniform distribution of hot combustion gas around its periphery, thereby enhancing equalization of temperature of the cooking gas around the discharge periphery of the centrifugal impeller.

2. The method of claim 1 further including the step of supplying the hot combustion gas from a burner in fluid communication with the mixing chamber through a conduit, whereby neither the conduit nor the burner remotely located substantially obstructs the flow of cooking gas around the top, bottom and two side walls of the cooking chamber.

3. The method of claim 2 further including the step of supplying hot combustion gas from the burner to the mixing chamber through a second conduit, the first conduit and second conduit disposed on opposite sides of the opening to the mixing chamber such that hot combustion gas fills mixing chamber on each side of the opening and such that the mixed cooking gas and hot combustion gas is permitted to flow substantially unimpeded around the conduits.

4. The method of claim 3 wherein the mixing chamber is comprised of first and second parallel plates; wherein the opening to the mixing chamber is defined in the first plate and the second plate defines an outlet to the centrifugal impeller substantially coaxial with the opening and the returning cooking gas to create a cooking gas flow to the inlet of the centrifugal impeller; and wherein the hot combustion gas fills the mixing chamber to circumscribe the cooking gas flow as it exits the mixing chamber and enters the inlet of centrifugal fan.

5. The method of claim 3 wherein the burner includes a combustion element mounted through a section of the wall in the cooking chamber on which the centrifugal fan is mounted, the section being immediately adjacent one of the interior surfaces of the top, bottom and two sides of the cooking chamber; the burner further including an enclosure to form a burner chamber that does not substantially impede the flow of cooking gas discharged from the centrifugal impeller along the one inside surface of the top, bottom and two sides of the cooking chamber, the burner chamber in fluid communication with the mixing chamber through the two conduits.

6. A convection cooking oven having improved temperature distribution comprising:

a cooking chamber peripherally defined by six sides of a six-sided enclosure;

a centrifugal impeller mounted on a first side of the six sides of the cooking chamber, said centrifugal impeller discharging uniformly around its periphery a flow of cooking gas, the flow of cooking gas travelling along the inside periphery of four of the six sides adjacent the first side toward an opposing, non-adjacent side, and returning toward the first side through a central portion of the cooking chamber;

a mixing chamber for creating a flow of gas having uniform distribution of hot combustion gas with the returning cooking gas to deliver to a central inlet of the centrifugal fan; the mixing chamber defined by a structure poised between the returning cooking gas and a central inlet to the centrifugal impeller and having an inlet to receive the returning gas and an outlet to deliver the hot combustion gas; the mixing chamber structure having dimensions that do not substantially impede the discharge of cooking gas from the centrifugal impeller and its flow along the four sides of the cooking chamber adjacent the first side when the structure is positioned between the returning cooking gas and the centrifugal impeller;

a burner for supplying hot combustion gas to the mixing chamber, the burner located apart from the mixing chamber in a position that does not substantially impede the flow of cooking gas from the centrifugal impeller and along the four sides of cooking chamber; and a conduit for supplying hot combustion gas from the burner to the mixing chamber, the conduit having dimensions which do not substantially obstruct the flow of cooking gas from the centrifugal impeller and along any of the four sides of the cooking chamber adjacent to the first side.

7. The convection oven of claim 6 wherein:

the structure of the mixing chamber includes first and second parallel plates that define the mixing chamber;

the inlet to the mixing chamber is a first orifice defined in the first plate and the outlet to the mixing chamber is a second orifice defined in the second plate; the first and second orifices aligned coaxially for maintaining the flow of return cooking gas to the centrifugal blower and the second orifice having dimensions larger than the first orifice; and the hot combustion gas surrounds the flow of returning cooking gas within the mixing chamber so as to tend to be uniformly drawn through the second orifice between the orifice's periphery and the flow of the combustion gas, thereby enhancing uniformity in discharging of hot combustion gas with the returning cooking gas from the centrifugal impeller around its periphery.

8. The convection oven of claim 7 wherein the mixing chamber and the conduit form an integral structure that is removably set inside of the oven, exposing the centrifugal fan when removed.

9. The convection oven of claim 6 wherein the burner is mounted through a peripheral portion of the first side of the cooking chamber and enclosed within a burner chamber structure that does not obstruct the flow of cooking gas along any of the four sides of the cooking chamber adjacent the first side, and wherein the conduits for supplying hot combustion gas provide fluid communication between the burner chamber and the mixing chamber without substantially impeding flow of cooking gas along any of the four of six sides of the cooking chamber adjacent the first side.

10. The convection oven of claim 9 wherein the mixing chamber structure, the conduits and the burner chamber structure are integrally formed to be set in the cooking chamber and removed to expose the centrifugal fan and the burner.

11. The convection oven of claim 9 wherein the burner is comprised of:

a burner body for mixing incoming air and fuel; and a burner tip coupled to the burner body, the burner tip having a hollow cylinder of porous material and a cap overlaying one open end of the porous material; the burner body delivering a mixture of air and fuel under pressure through a second open end of the cylinder of porous material and forcing the air and fuel mixture through the porous material to be ignited, thereby creating a compact heat source that evenly distributes heat within the burner box.

12. A mixing chamber structure for mixing of hot combustion gas with cooler gas and providing this gas mixture to a fan, the mixing chamber structure providing more uniform temperature distribution in the mixture for delivery to the fan, the mixing chamber structure comprising:

first and second parallel plates defining therebetween a chamber;

two spaced-apart conduits for communicating a flow of hot combustion gas from a remotely located burner, each conduit being coupled to the first and second plates on opposite sides of the inlet orifice for delivery of the hot combustion gas to the chamber on opposite sides of the flow of cooler gas, thereby facilitating a more even distribution of hot combustion gas within the chamber around the flow of returning cooking gas;

an inlet orifice defined in the first parallel plate for receiving cooler gas and adapted to define a flow of cooler gas through the chamber, the chamber distributing the hot gas relatively uniformly surrounding the flow of cooking gas;

a fan having a central inlet; and an outlet orifice defined in the second plate for aligning with a central inlet to a fan, the outlet orifice having a diameter larger than the diameter of the inlet orifice and substantially aligned with the inlet orifice for permitting the fan to draw the flow of cooler gas along with a coaxial flow of the hot combustion gas distributed around the periphery of the flow of cooler gas.

* * * * *